US005839665A

United States Patent [19]

DiVittorio

[11] Patent Number: 5,839,665

[45] Date of Patent: Nov. 24, 1998

[54] SPRINKLER SYSTEM

[76] Inventor: Adrian G. DiVittorio, 1509 Ridgeland Rd., E. Mobile, Ala. 36695

[21] Appl. No.: 891,589

[22] Filed: Jul. 11, 1997

[51] Int. Cl.[6] ..... B05B 7/30

[52] U.S. Cl. ..... 239/310; 251/314

[58] Field of Search ..... 239/200, 201, 239/207, 309, 310, 314, 316, 575, 581.1, 582.1, 590, 590.3; 251/314, 316

[56] References Cited

U.S. PATENT DOCUMENTS

| | | | |
|---|---|---|---|
| 1,755,610 | 4/1930 | Palmer | 239/310 |
| 2,606,068 | 8/1952 | Bonacor | 239/310 |
| 3,174,691 | 3/1965 | Haviland | 239/314 |
| 3,833,177 | 9/1974 | Pasley et al. | 239/201 |
| 4,756,479 | 7/1988 | Lazenby, III | 239/581.1 |
| 4,795,096 | 1/1989 | Smith | 239/288.3 |
| 4,956,883 | 9/1990 | Lane | 4/605 |
| 5,022,585 | 6/1991 | Burgess | 239/310 |
| 5,413,280 | 5/1995 | Taylor | 239/310 |
| 5,699,827 | 12/1997 | Delorme et al. | 239/310 |

*Primary Examiner*—Andres Kashnikow
*Assistant Examiner*—Dinh Q. Nguyen
*Attorney, Agent, or Firm*—Joseph N. Breaux

[57] ABSTRACT

A sprinkler system that includes multiple lawn chemical distributing assemblies that each include a pipe connector member having a water flow passageway formed through the length thereof; a ball valve assembly having a ball valve seal positioned within the water flow passageway of the pipe connector member and an elongated actuator shaft extending perpendicularly from the pipe connector member and terminating in an actuator handle; an exteriorly threaded reservoir connector having a chemical dispersal passageway formed therethrough and into connection with the water flow passageway of the pipe connector member; a cone shaped in-ground chemical reservoir member, the chemical reservoir member having an inverted cone shaped chemical holding cavity, a fill opening rimmed by an externally threaded cap engaging lip, and an internally threaded pipe connection portion companionately threaded to engage the exteriorly threaded reservoir connector, the reservoir member being attachable to the exteriorly threaded reservoir connector in a manner such that the externally threaded cap engaging lip is positioned at the same height above the pipe connector member as the actuator handle of the elongated actuator shaft; a filter screen sized to fit within the internally threaded pipe connection portion; and an internally threaded sealing cap companionately threaded to engage the externally threaded cap engaging lip.

18 Claims, 3 Drawing Sheets

SPRINKLER SYSTEM

TECHNICAL FIELD

The present invention relates to lawn and garden sprinkler systems and methods of sprinkler system installation and more particularly to a sprinkler system that includes multiple lawn chemical distributing assemblies that each include a pipe connector member having a water flow passageway formed through the length thereof; a ball valve assembly having a ball valve seal positioned within the water flow passageway of the pipe connector member and an elongated actuator shaft extending perpendicularly from the pipe connector member and terminating in an actuator handle, the ball valve seal being positionable into a first position allowing the flow of water through the water flow passageway of the pipe connector member and into a second position blocking the flow of water through the water flow passageway of the pipe connector member; an exteriorly threaded reservoir connector having a chemical dispersal passageway formed therethrough and into connection with the water flow passageway of the pipe connector member; a cone shaped in-ground chemical reservoir member, the chemical reservoir member having an inverted cone shaped chemical holding cavity, a fill opening rimmed by an externally threaded cap engaging lip, and an internally threaded pipe connection portion companionately threaded to engage the exteriorly threaded reservoir connector, the reservoir member being attachable to the exteriorly threaded reservoir connector in a manner such that the externally threaded cap engaging lip is positioned at the same height above the pipe connector member as the actuator handle of the elongated actuator shaft; a filter screen sized to fit within the internally threaded pipe connection portion; and an internally threaded sealing cap companionately threaded to engage the externally threaded cap engaging lip.

BACKGROUND OF THE INVENTION

Maintaining a healthy lawn and garden can be time consuming. In particular, watering and applying lawn chemicals to different areas or zones of a lawn and garden can be both bothersome and time consuming. It would be a benefit, therefore, to have a sprinkler system that included a separate chemical distributing assembly for each zone of the sprinkler system to allow the user to target the different zones with different lawn chemical combinations. Because it can be desirable to temporarily disable water flow to a particular zone of the sprinkler system when adding or changing lawn chemicals it would be a further benefit if each of the chemical distributing assemblies included a valve assembly. Because it can be desirable to treat each zone over a period of time, it would be a benefit if each of the chemical distributing assemblies included a detachable chemical reservoir member that could be installed beneath the ground with a removable cap positioned at the ground surface level to provide an access opening for adding additional lawn care chemicals when needed.

SUMMARY OF THE INVENTION

It is thus an object of the invention to provide a sprinkler system that includes a separate chemical distributing assembly for each zone of the sprinkler system.

It is a further object of the invention to provide a sprinkler system that includes a number of chemical distributing assemblies wherein each chemical distributing assembly includes a valve assembly.

It is a still further object of the invention to provide a sprinkler system that includes a number of chemical distributing assemblies wherein each of the chemical distributing assemblies includes a detachable chemical reservoir member that can be installed beneath the ground and that includes a removable cap positionable at the ground surface level to provide an access opening for adding additional lawn care chemicals to the detachable chemical reservoir when needed.

It is a still further object of the invention to provide a sprinkler system that includes multiple lawn chemical distributing assemblies that each include a pipe connector member having a water flow passageway formed through the length thereof; a ball valve assembly having a ball valve seal positioned within the water flow passageway of the pipe connector member and an elongated actuator shaft extending perpendicularly from the pipe connector member and terminating in an actuator handle, the ball valve seal being positionable into a first position allowing the flow of water through the water flow passageway of the pipe connector member and into a second position blocking the flow of water through the water flow passageway of the pipe connector member; an exteriorly threaded reservoir connector having a chemical dispersal passageway formed therethrough and into connection with the water flow passageway of the pipe connector member; a cone shaped in-ground chemical reservoir member, the chemical reservoir member having an inverted cone shaped chemical holding cavity, a fill opening rimmed by an externally threaded cap engaging lip, and an internally threaded pipe connection portion companionately threaded to engage the exteriorly threaded reservoir connector, the reservoir member being attachable to the exteriorly threaded reservoir connector in a manner such that the externally threaded cap engaging lip is positioned at the same height above the pipe connector member as the actuator handle of the elongated actuator shaft; a filter screen sized to fit within the internally threaded pipe connection portion; and an internally threaded sealing cap companionately threaded to engage the externally threaded cap engaging lip.

It is a still further object of the invention to provide a method of installing a multi-zone sprinkler system that includes the step of installing a lawn chemical distributing assembly in each zone area of the sprinkler system that includes a pipe connector member having a water flow passageway formed through the length thereof; a ball valve assembly having a ball valve seal positioned within the water flow passageway of the pipe connector member and an elongated actuator shaft extending perpendicularly from the pipe connector member and terminating in an actuator handle, the ball valve seal being positionable into a first position allowing the flow of water through the water flow passageway of the pipe connector member and into a second position blocking the flow of water through the water flow passageway of the pipe connector member; an exteriorly threaded reservoir connector having a chemical dispersal passageway formed therethrough and into connection with the water flow passageway of the pipe connector member; a cone shaped in-ground detachable chemical reservoir member, the chemical reservoir member having an inverted cone shaped chemical holding cavity, a fill opening rimmed by an externally threaded cap engaging lip, and an internally threaded pipe connection portion companionately threaded to engage the exteriorly threaded reservoir connector, the reservoir member being attachable to the exteriorly threaded reservoir connector in a manner such that the externally threaded cap engaging lip is positioned at the same height above the pipe connector member as the actuator handle of the elongated actuator shaft; a filter screen sized to fit within the internally threaded pipe connection portion; and an internally threaded sealing cap companionately threaded to engage the externally threaded cap engaging lip; the detachable chemical reservoir member being installed beneath the ground, the removable cap being positioned at the ground surface level to provide an access opening for adding additional lawn care chemicals to the detachable chemical reservoir when needed.

It is a still further object of the invention to provide a sprinkler system that accomplishes some or all of the above objects in combination.

Accordingly, in a first aspect of the invention a sprinkler system is provided. The sprinkler system includes multiple lawn chemical distributing assemblies that each include a pipe connector member having a water flow passageway formed through the length thereof; a ball valve assembly having a ball valve seal positioned within the water flow passageway of the pipe connector member and an elongated actuator shaft extending perpendicularly from the pipe connector member and terminating in an actuator handle, the ball valve seal being positionable into a first position allowing the flow of water through the water flow passageway of the pipe connector member and into a second position blocking the flow of water through the water flow passageway of the pipe connector member; an exteriorly threaded reservoir connector having a chemical dispersal passageway formed therethrough and into connection with the water flow passageway of the pipe connector member; a cone shaped in-ground chemical reservoir member, the chemical reservoir member having an inverted cone shaped chemical holding cavity, a fill opening rimmed by an externally threaded cap engaging lip, and an internally threaded pipe connection portion companionately threaded to engage the exteriorly threaded reservoir connector, the reservoir member being attachable to the exteriorly threaded reservoir connector in a manner such that the externally threaded cap engaging lip is positioned at the same height above the pipe connector member as the actuator handle of the elongated actuator shaft; a filter screen sized to fit within the internally threaded pipe connection portion; and an internally threaded sealing cap companionately threaded to engage the externally threaded cap engaging lip.

In a second aspect of the invention a method of installing a multi-zone sprinkler system is provided. The sprinkler installation method comprises the step of installing a lawn chemical distributing assembly in each zone area of the sprinkler system that includes a pipe connector member having a water flow passageway formed through the length thereof; a ball valve assembly having a ball valve seal positioned within the water flow passageway of the pipe connector member and an elongated actuator shaft extending perpendicularly from the pipe connector member and terminating in an actuator handle, the ball valve seal being positionable into a first position allowing the flow of water through the water flow passageway of the pipe connector member and into a second position blocking the flow of water through the water flow passageway of the pipe connector member; an exteriorly threaded reservoir connector having a chemical dispersal passageway formed therethrough and into connection with the water flow passageway of the pipe connector member; a cone shaped in-ground detachable chemical reservoir member, the chemical reservoir member having an inverted cone shaped chemical holding cavity, a fill opening rimmed by an externally threaded cap engaging lip, and an internally threaded pipe connection portion companionately threaded to engage the exteriorly threaded reservoir connector, the reservoir member being attachable to the exteriorly threaded reservoir connector in a manner such that the externally threaded cap engaging lip is positioned at the same height above the pipe connector member as the actuator handle of the elongated actuator shaft; a filter screen sized to fit within the internally threaded pipe connection portion; and an internally threaded sealing cap companionately threaded to engage the externally threaded cap engaging lip; the detachable chemical reservoir member being installed beneath the ground, the removable cap being positioned at the ground surface level to provide an access opening for adding additional lawn care chemicals to the detachable chemical reservoir when needed.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
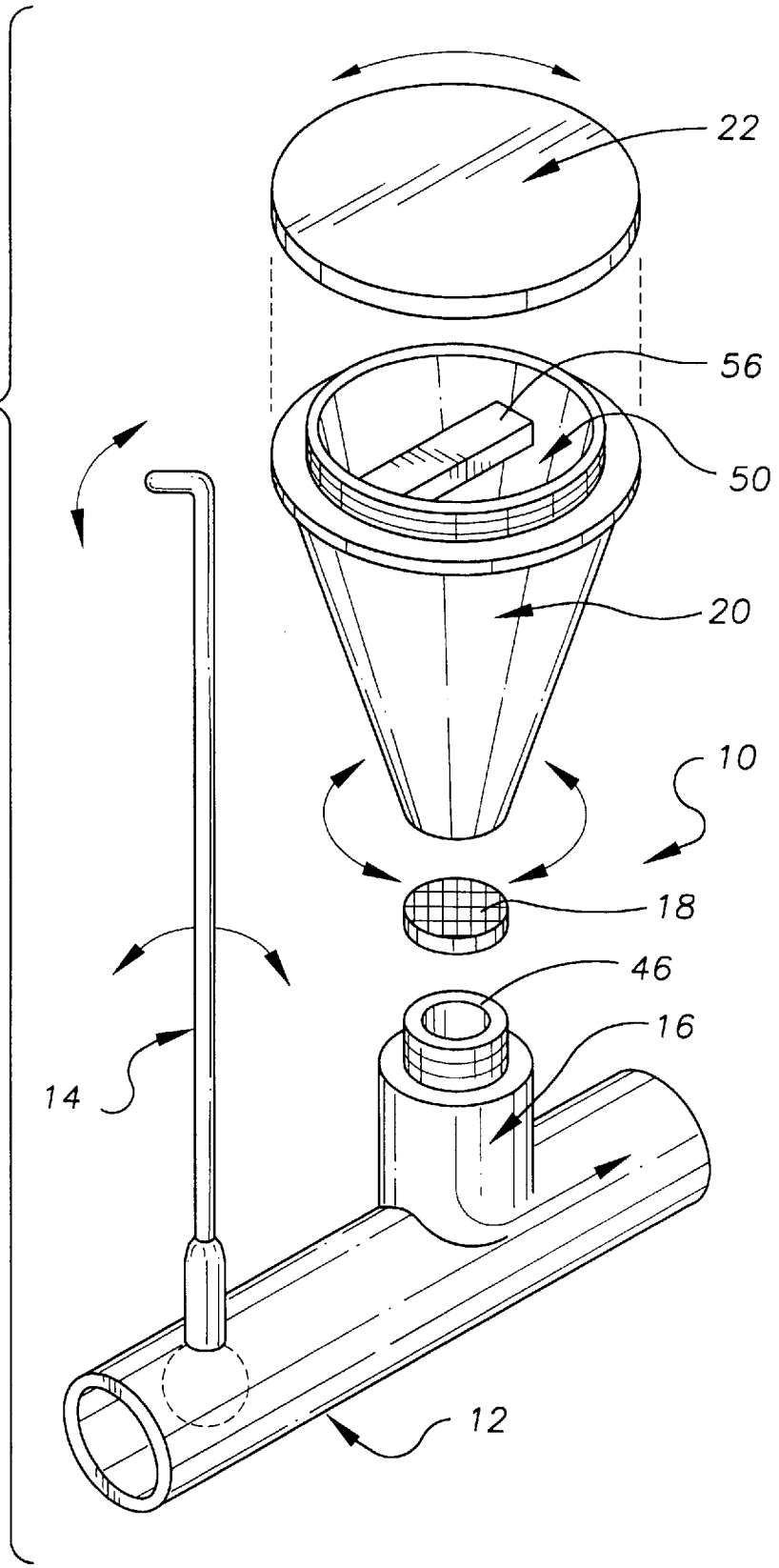
FIG. 1 is a perspective view of an exemplary embodiment of one of the identical chemical distributing assemblies of the sprinkler system of the present invention showing the pipe connector member; the ball valve with the elongated actuator shaft; the exteriorly threaded reservoir connector; the filter screen; the cone shaped in-ground chemical reservoir member with the inverted cone shaped chemical holding cavity, the fill opening rimmed by the externally threaded cap engaging lip, and the internally threaded pipe connection; and the internally threaded sealing cap.

FIG. 1 shows an exemplary embodiment of one of the identical chemical distributing assemblies of the sprinkler system of the present invention, generally designated by the numeral 10. In this embodiment lawn chemical distribution assembly 10 includes a pipe connector member, generally designated 12; a ball valve assembly, generally designated 14; an exteriorly threaded reservoir connector, generally designated 16; a filter screen 18; a cone shaped in-ground chemical reservoir member, generally designated 20; and an internally threaded sealing cap, generally designated 22.

Figure 2:
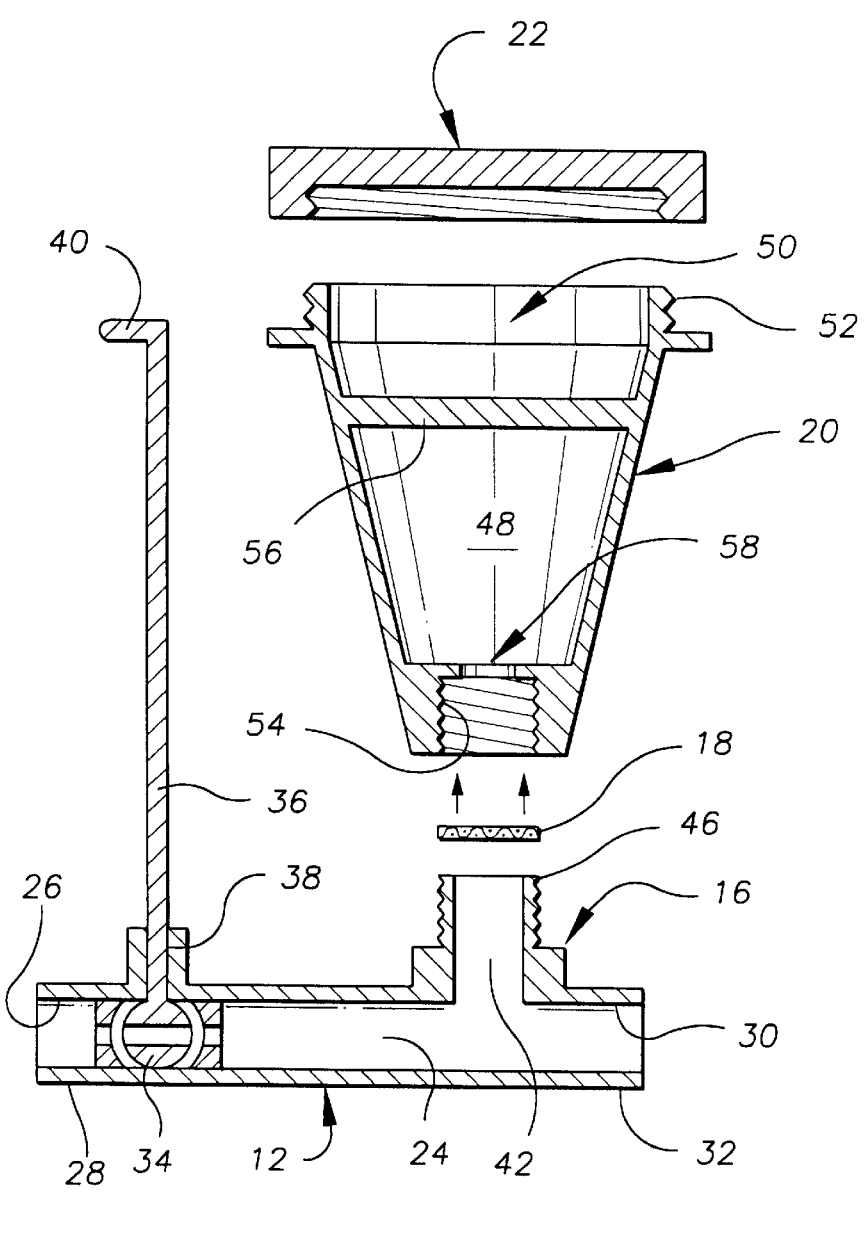
FIG. 2 is a cross-section plan view of the exemplary chemical distributing assembly of FIG. 1 showing the water flow passageway through the pipe connector member; the ball valve seal positioned within the water flow passageway of the pipe connector member; the chemical dispersal passageway formed through the exteriorly threaded reservoir connector in connection with the water flow passageway through the pipe connector member; the filter screen; the cone shaped in-ground chemical reservoir member with the inverted cone shaped chemical holding cavity, the fill opening rimmed by the externally threaded cap engaging lip, and the internally threaded pipe connection; and the internally threaded sealing cap.

With reference now to FIG. 2, pipe connecting member 12 has a water flow passageway 24 formed through the length thereof and terminates at a first end 26 in a first pipe end receiving fitting 28 and at a second end 30 in a second pipe end receiving fitting 32.

A conventional ball valve seal 34 is positioned within water flow passageway 24. An elongated actuator shaft 36 extends from ball valve seal 34 through a valve actuator passageway 38 and terminates in a valve actuator handle 40.

In this embodiment, exteriorly threaded reservoir connector 16 is integrally formed with pipe connector member 12. Exteriorly threaded reservoir connector 16 has a chemical dispersal passageway 42 formed through the length thereof that is in fluid communication with water flow passageway 24 of pipe connector member 12. In this embodiment, elongated actuator shaft 36 and exteriorly threaded reservoir connector 16 extend away from pipe connector member 12 in the same direction.

Filter screen 18 is a round disk shaped section of conventional plastic screening material that is sized in a manner such that the perimeter edge of filter screen 18 is positionable in registration with the top circumferential edge 46 (also shown in FIG. 1) of exteriorly threaded reservoir connector 16.

Cone shaped in-ground chemical reservoir member 20 is of molded ABS plastic construction and includes an inverted cone shaped chemical holding cavity 48, a fill opening 50 (see also FIG. 1) rimmed by an externally threaded cap engaging lip 52, an internally threaded pipe connection 54; and a grasping bar 56 (more clearly shown in FIG. 1). Inverted cone shaped chemical holding cavity 48 is in fluid communication with internally threaded pipe connection 54 through cavity opening 58 and in a manner such that a fluid pathway exists between inverted cone shaped chemical holding cavity 48 and water flow passageway 24 of pipe connector member 12 when internally threaded pipe connection 54 is threaded onto externally threaded reservoir connector 16. Fill opening 50 is sealable by screwing internally threaded, molded ABS plastic sealing cap 22 onto externally threaded cap engaging lip 52.

Figure 3:
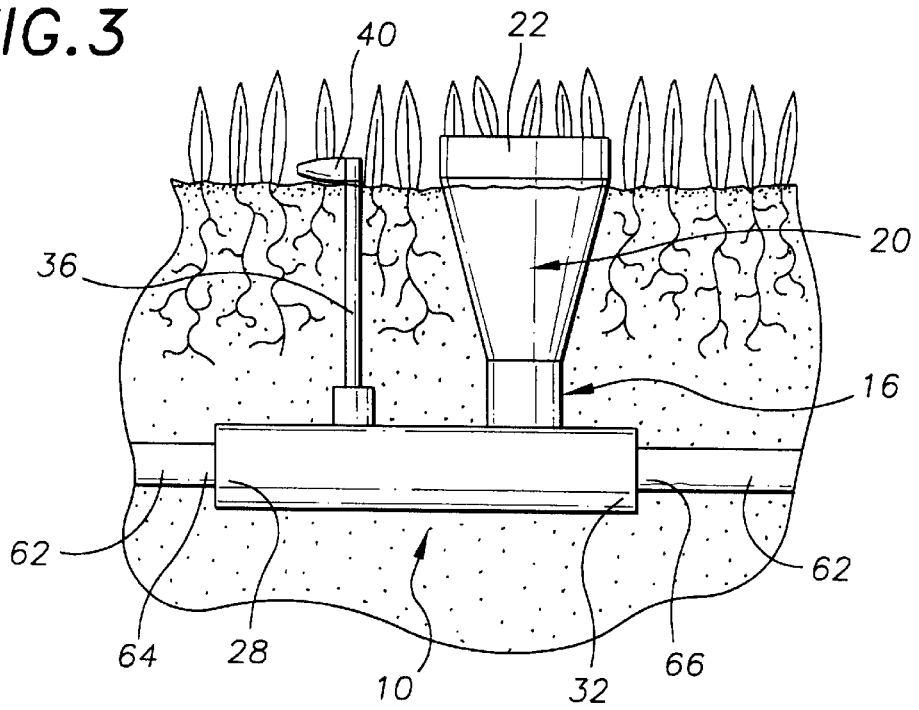
FIG. 3 is a side plan view representation of the exemplary chemical distributing assembly of FIG. 1 with the pipe connector member installed in-line with the water pipe of one line of an exemplary sprinkler system showing the actuator handle at the end of the elongated actuator shaft of the ball valve, the fill opening of the reservoir member and the internally threaded sealing cap positioned at the ground surface level.

With reference to FIG. 3, in use each lawn chemical distribution assembly 10 is installed in-line with a water pipe 62 of one zone supply line of an exemplary sprinkler system by gluing a first water pipe end 64 into first pipe end receiving fitting 28 and gluing a second water pipe end 66 into second pipe end receiving fitting 32. Filter screen 18 (FIG. 2) is then positioned onto top circumferential edge 46 (FIG. 2) of exteriorly threaded reservoir connector 16 and the internally threaded pipe connection 54 (FIG. 2) of cone shaped in-ground chemical reservoir member 20 threaded down onto exteriorly threaded reservoir connector 16. Cone shaped in-ground chemical reservoir member 20 and elongated valve actuator 36 are then buried in the ground in a manner such that internally threaded sealing cap 22 and valve actuator handle 40 are positioned at the ground surface level.

Figure 4:
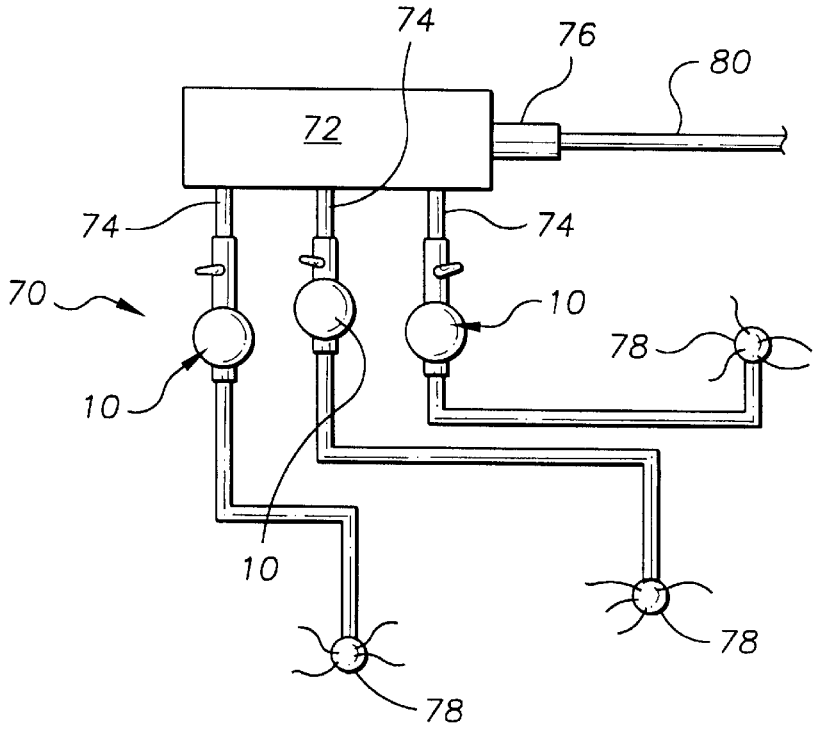
FIG. 4 is a schematic diagram showing a representative sprinkler system of the present invention showing a standard automated sprinkler zone controller having three sprinkler zone outlets and one supply inlet; a main water supply feed in connection with the supply inlet; three identical chemical distributing assemblies, one installed in-line with each of the three sprinkler zone outlets; and three representative sprinkler heads, one installed in connection with each of the three identical chemical distributing assemblies.

FIG. 4 shows an exemplary sprinkler system 70 that includes a standard three zone, automated sprinkler zone controller 72 having three sprinkler zone outlets 74 and one sprinkler supply inlet 76; three representative sprinkler heads 78; three lawn chemical distribution assemblies 10 installed in the manner previously described in connection between sprinkler zone outlets 74 and sprinkler heads 78; and a main water supply feed line 80 in connection with supply inlet 76.

It can be seen from the preceding description that a sprinkler system has been provided that includes a separate chemical distributing assembly for each zone of the sprinkler system; that includes a number of chemical distributing assemblies wherein each chemical distributing assembly includes a valve assembly; that includes a number of chemical distributing assemblies wherein each of the chemical distributing assemblies includes a detachable chemical reservoir member that can be installed beneath the ground and that includes a removable cap positionable at the ground surface level to provide an access opening for adding additional lawn care chemicals to the detachable chemical reservoir when needed; and that includes multiple lawn chemical distributing assemblies that each include a pipe connector member having a water flow passageway formed through the length thereof; a ball valve assembly having a ball valve seal positioned within the water flow passageway of the pipe connector member and an elongated actuator shaft extending perpendicularly from the pipe connector member and terminating in an actuator handle, the ball valve seal being positionable into a first position allowing the flow of water through the water flow passageway of the pipe connector member and into a second position blocking the flow of water through the water flow passageway of the pipe connector member; an exteriorly threaded reservoir connector having a chemical dispersal passageway formed therethrough and into connection with the water flow passageway of the pipe connector member; a cone shaped in-ground chemical reservoir member, the chemical reservoir member having an inverted cone shaped chemical holding cavity, a fill opening rimmed by an externally threaded cap engaging lip, and an internally threaded pipe connection portion companionately threaded to engage the exteriorly threaded reservoir connector, the reservoir member being attachable to the exteriorly threaded reservoir connector in a manner such that the externally threaded cap engaging lip is positioned at the same height above the pipe connector member as the actuator handle of the elongated actuator shaft; a filter screen sized to fit within the internally threaded pipe connection portion; and an internally threaded sealing cap companionately threaded to engage the externally threaded cap engaging lip. It can also be seen that a method of installing a sprinkler system has been provided that includes the step of installing a lawn chemical distributing assembly in each zone area of a sprinkler system that includes a pipe connector member having a water flow passageway formed through the length thereof; a ball valve assembly having a ball valve seal positioned within the water flow passageway of the pipe connector member and an elongated actuator shaft extending perpendicularly from the pipe connector member and terminating in an actuator handle, the ball valve seal being positionable into a first position allowing the flow of water through the water flow passageway of the pipe connector member and into a second position blocking the flow of water through the water flow passageway of the pipe connector member; an exteriorly threaded reservoir connector having a chemical dispersal passageway formed therethrough and into connection with the water flow passageway of the pipe connector member; a cone shaped in-ground detachable chemical reservoir member, the chemical reservoir member having an inverted cone shaped chemical holding cavity, a fill opening rimmed by an externally threaded cap engaging lip, and an internally threaded pipe connection portion companionately threaded to engage the exteriorly threaded reservoir connector, the reservoir member being attachable to the exteriorly threaded reservoir connector in a manner such that the externally threaded cap engaging lip is positioned at the same height above the pipe connector member as the actuator handle of the elongated actuator shaft; a filter screen sized to fit within the internally threaded pipe connection portion; and an internally threaded sealing cap companionately threaded to engage the externally threaded cap engaging lip; the detachable chemical reservoir member being installed beneath the ground, the removable cap being positionable at the ground surface level to provide an access opening for adding additional lawn care chemicals to the detachable chemical reservoir when needed.

It is noted that the embodiment of the sprinkler system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A sprinkler system comprising:

multiple lawn chemical distributing assemblies, each lawn chemical distributing assembly including:

a pipe connector member having a water flow passageway formed through said length thereof;

a ball valve assembly having a ball valve seal positioned within said water flow passageway of said pipe connector member and an elongated actuator shaft extending perpendicularly from said pipe connector member and terminating in an actuator handle, said ball valve seal being positionable into a first position allowing the flow of water through said water flow passageway of said pipe connector member and into a second position blocking said flow of water through said water flow passageway of said pipe connector member;

an exteriorly threaded reservoir connector having a chemical dispersal passageway formed therethrough and into connection with said water flow passageway of said pipe connector member;

a cone shaped in-ground chemical reservoir member, said chemical reservoir member having chemical holding cavity, a fill opening rimmed by an externally threaded cap engaging lip, and an internally threaded pipe connection portion companionately threaded to engage said exteriorly threaded reservoir connector, said reservoir member being attachable to said exteriorly threaded reservoir connector in a manner such that said externally threaded cap engaging lip is positioned a distance above said pipe connector member equal with said actuator handle of said elongated actuator shaft;

a filter screen sized to fit within said internally threaded pipe connection portion; and an internally threaded sealing cap companionately threaded to engage said externally threaded cap engaging lip.

2. The sprinkler system of claim 1, wherein:

said cone shaped in-ground chemical reservoir member includes a grasping bar that extends across said chemical holding cavity.

3. The sprinkler system of claim 1, wherein:

said chemical holding cavity is cone shaped.

4. The sprinkler system of claim 1 wherein:

said exteriorly threaded reservoir connector is integrally formed with said pipe connector member.

5. The sprinkler system of claim 1 further including:

an automated sprinkler zone controller having a plurality of sprinkler zone outlets and one sprinkler supply inlet;

peach said zone outlet being in connection with a said water flow passageway of a said pipe connector member of one of said multiple lawn chemical distributing assemblies.

6. The sprinkler system of claim 1 wherein:

said elongated actuator shaft and said exteriorly threaded reservoir connector extend away from said pipe connector member in the same direction.

7. The sprinkler system of claim 2, wherein:

said chemical holding cavity is cone shaped.

8. The sprinkler system of claim 2 wherein:

said exteriorly threaded reservoir connector is integrally formed with said pipe connector member.

9. The sprinkler system of claim 2 further including:

an automated sprinkler zone controller having a plurality of sprinkler zone outlets and one sprinkler supply inlet;

each said zone outlet being in connection with a said water flow passageway of a said pipe connector member of one of said multiple lawn chemical distributing assemblies.

10. The sprinkler system of claim 2 wherein:

said elongated actuator shaft and said exteriorly threaded reservoir connector extend away from said pipe connector member in the same direction.

11. The sprinkler system of claim 7 wherein:

said exteriorly threaded reservoir connector is integrally formed with said pipe connector member.

12. The sprinkler system of claim 7 further including:

an automated sprinkler zone controller having a plurality of sprinkler zone outlets and one sprinkler supply inlet;

each said zone outlet being in connection with a said water flow passageway of a said pipe connector member of one of said multiple lawn chemical distributing assemblies.

13. The sprinkler system of claim 7 wherein:

said elongated actuator shaft and said exteriorly threaded reservoir connector extend away from said pipe connector member in the same direction.

14. The sprinkler system of claim 11 further including:

an automated sprinkler zone controller having a plurality of sprinkler zone outlets and one sprinkler supply inlet;

each said zone outlet being in connection with a said water flow passageway of a said pipe connector member of one of said multiple lawn chemical distributing assemblies.

15. The sprinkler system of claim 11 wherein:

said elongated actuator shaft and said exteriorly threaded reservoir connector extend away from said pipe connector member in the same direction.

16. The sprinkler system of claim 14 wherein:

said elongated actuator shaft and said exteriorly threaded reservoir connector extend away from said pipe connector member in the same direction.

17. The sprinkler system of claim 8 further including:

an automated sprinkler zone controller having a plurality of sprinkler zone outlets and one sprinkler supply inlet;

each said zone outlet being in connection with a said water flow passageway of a said pipe connector member of one of said multiple lawn chemical distributing assemblies.

18. A method of installing a multi-zone sprinkler system comprising:

a) providing a lawn chemical distributing assembly for each zone to be provided in the multi-zone sprinkler system, each lawn chemical distributing assembly including a pipe connector member having a water flow passageway formed through said length thereof; a ball valve assembly having a ball valve seal positioned within said water flow passageway of said pipe connector member and an elongated actuator shaft extending perpendicularly from said pipe connector member and terminating in an actuator handle, said ball valve seal being positionable into a first position allowing the flow of water through said water flow passageway of said pipe connector member and into a second position blocking said flow of water through said water flow passageway of said pipe connector member; an exteriorly threaded reservoir connector having a chemical dispersal passageway formed therethrough and into connection with said water flow passageway of said pipe connector member; a cone shaped in-ground detachable chemical reservoir member, said chemical reservoir member having an inverted cone shaped chemical holding cavity, a fill opening rimmed by an externally threaded cap engaging lip, and an internally threaded pipe connection portion companionately threaded to engage said exteriorly threaded reservoir connector, said reservoir member being attachable to said exteriorly threaded reservoir connector in a manner such that said externally threaded cap engaging lip is positioned at the same height above said pipe connector member as said actuator handle of said elongated actuator shaft; a filter screen sized to fit within said internally threaded pipe connection portion; and an internally threaded sealing cap companionately threaded to engage said externally threaded cap engaging lip;

b) installing a lawn chemical distributing assembly in each zone to be provided in the multi-zone sprinkler system in a manner such that each said detachable chemical reservoir member is installed beneath ground and said removable cap is positioned at ground surface level to provide an access opening for adding additional lawn care chemicals to said detachable chemical reservoir when needed.

* * * * *